US005679170A

United States Patent [19]

Frenier

[11] Patent Number: 5,679,170

[45] **Date of Patent: *Oct. 21, 1997**

[54] METHODS FOR REMOVING IRON OXIDE SCALE FROM INTERIOR SURFACES OF STEEL VESSELS USING FORMIC ACID-CITRIC ACID MIXTURES

[75] Inventor: Wayne W. Frenier, Tulsa, Okla.

[73] Assignee: HydroChem Industrial Services, Inc., Houston, Tex.

[ * ] Notice: The term of this patent shall not extend beyond the expiration date of Pat. No. 5,529,637.

[21] Appl. No.: 569,320

[22] Filed: Dec. 8, 1995

Related U.S. Application Data

[63] Continuation of Ser. No. 197,595, Feb. 17, 1994, abandoned.

[51] Int. Cl.[6] ..... B08B 3/08; B08B 9/00; C23G 1/02; C23G 1/08

[52] U.S. Cl. ..... 134/3; 134/10; 134/22.13; 134/22.14; 134/22.16; 134/22.17; 134/22.19; 134/41

[58] Field of Search ..... 134/22.14, 22.19, 134/22.13, 22.16, 22.17, 10, 3, 41; 252/80, 103, 156; 210/724, 722; 510/247, 253, 255

[56] References Cited

U.S. PATENT DOCUMENTS

| | | | |
|---|---|---|---|
| 1,892,093 | 12/1932 | Battistella . | |
| 2,084,361 | 6/1937 | Vanderbilt | 148/8 |
| 2,423,385 | 7/1947 | Hixson et al. | 134/10 |
| 2,462,341 | 2/1949 | Tremaine | 252/100 |
| 2,516,685 | 7/1950 | Douty | 252/100 |
| 3,003,898 | 10/1961 | Reich | 134/22.19 |
| 3,003,899 | 10/1961 | Eberhard et al. | 134/22.14 |
| 3,072,502 | 1/1963 | Albano | 134/3 |
| 3,171,800 | 3/1965 | Rice et al. | 210/722 |
| 3,296,143 | 1/1967 | Boiko | 252/87 |
| 3,298,931 | 1/1967 | Herbert et al. | 203/7 |
| 3,492,238 | 1/1970 | Wohlberg | 252/87 |
| 3,530,000 | 9/1970 | Searles | 134/22.1 |
| 3,915,633 | 10/1975 | Ramachandran | 8/137 |
| 4,174,290 | 11/1979 | Leveskis | 134/3 |
| 4,595,517 | 6/1986 | Abadi | 252/82 |
| 4,637,899 | 1/1987 | Kennedy, Jr. | 252/542 |
| 4,855,069 | 8/1989 | Schuppiser et al. | 252/87 |
| 5,021,096 | 6/1991 | Abadi | 134/22.1 |
| 5,045,352 | 9/1991 | Mueller | 427/235 |
| 5,360,488 | 11/1994 | Hieatt et al. | 134/22.14 |

FOREIGN PATENT DOCUMENTS

| | | | |
|---|---|---|---|
| 0041270 | 4/1979 | Japan | 210/722 |
| 0214391 | 12/1983 | Japan | 210/722 |

OTHER PUBLICATIONS

McLaughlin, L.G., "Improved Acid Solution for Boilers Removes Oxides Without Precipitate", E.I. duPont de Nemours & Co., Inc., Wlimington, Delaware, Aug. 1963, pp. 52, 54, 57.

Frenier et al., "Mechanism of Iron Oxide Dissolution—A Review of Recent Literature", 1984.

*Primary Examiner*—Zeinab El-Arini
*Attorney, Agent, or Firm*—Browning Bushman

[57] ABSTRACT

A method and solution for removing iron oxide-containing scale from the interior surfaces of steel vessels. During normal cleaning procedures for internal scale-encrusted steel surfaces of a utility boiler, a reducing atmosphere is maintained, and an aqueous solution containing an about 4:1 to about 9:1 weight ratio of formic acid and citric acid, is placed in dissolving relation to the scale. The high F/C ratios hold more iron in solution than low F/C ratios, especially if the iron is kept in the 2+oxidation state. The ability of the solution to hold dissolved iron is only slightly dependent on pH, so long as pH is maintained below 7.0. An oxidation stage is not required to remove dissolved iron to below 1 ppm from the solution, during waste treatment procedures using lime and NaOH.

21 Claims, 14 Drawing Sheets

Iron vs Time for 2% F/C 4/1 at 150 F
App Pwr Tubes, 0.1% Inh "B"

Iron vs Time for 2% F/C 4/1 at 200 F
App Pwr Tubes, 0.2% Inh "A"

Iron vs Time for 2% F/C 4/1 at 200 F
SoCal Ed Tubes, 0.2% Inh "A"

Iron vs Time for 2% F/C 4/1 at 200 F
SoCal Ed Tubes, 0.3% Inh "A"

Iron vs Time for 2% F/C 9/1 at 150 F
SoCal Ed Tubes, 0.2% Inh "B"

Iron vs Time for 2% F/C 9/1 at 200 F
SoCal Ed Tubes, 0.3% Inh "A"

Iron vs Time for 2% F/C 9.0/1 at 150 F
CG & E Tubes, 0.1% Inh "B"

Iron vs Time for 2% F/C 9/1 at 200 F
CG & E Tubes, 0.2% Inh "A"

Iron vs Time for 2% F/C 9/1 at 200 F
CG & E Tubes, 0.2% Inh "B"

[Fe(II)] vs Time Curves for Various Concentrations of F/C 6.5/1 and F/C 9/1
Maximum Spending, Fe Powder at 200 F

METHODS FOR REMOVING IRON OXIDE SCALE FROM INTERIOR SURFACES OF STEEL VESSELS USING FORMIC ACID-CITRIC ACID MIXTURES

This is a continuation of U.S. patent application Ser. No. 08/197,595 filed on Feb. 17, 1994, and now abandoned.

BACKGROUND OF THE INVENTION

The steel plates and tubes which typically provide the internally available surfaces of drumless boilers can be made of various steel alloys which lack copper. Ones known to the present inventor to be frequently encountered are:

A515Gr70 Boiler Plate

ASTM A182F22 (A213T22)- 2¼ percent Cr

ASTM A182F11 (A213T11)- 1¼ percent Cr

ASTM A213T2-½ percent Cr

ASTM A182F1-½ percent Mo

Drumless boilers, such as Babcock & Wilcox Universal Pressure and Combustion Engineering supercritical units do not circulate water in the tubes, but are "once-through". This fact, as well as a lack of copper-based metallurgy in the feedwater train of such boilers, and consistently high-quality water chemistry used in the operation of such boilers, causes the deposits which inevitably form in the tubes of those drumless boilers to be magnetite of a fairly consistent composition, without the copper that is often found in the deposits that form in drum boilers.

It is known that, EDTA solvent-based cleaning solutions, such as $(NH_4)_4$ EDTA-containing and $(NH_4)_2$ EDTA-containing solutions will readily remove those magnetite deposits from the internal surfaces of drumless boilers.

When magnetite is dissolved in the presence of an iron surface or iron is corroded by acid, Fe(II) ions are released into solution:

$$Fe_3O_4+8H^+=2Fe^{3+}+Fe^{2+}+4H_2O \quad (1)$$

$$Fe+2Fe^{3+}=3Fe2^{+} \quad (2)$$

$$Fe+Fe_3O_4+8H^+=4\ Fe^{2+}+4H_2O \quad (3)$$

$$Fe+2H^+=H_2+Fe^{2+} \quad (4)$$

The expense of EDTA solvents has led chemical cleaning service providers to focus on less expensive alternatives.

Reich, U.S. Pat. No. 3,003,898, issued Oct. 10, 1961, discloses a method and composition for removing scale and tenacious foreign matter from internal surfaces of metal-walled (typically steel-walled) vessels used for storing, transferring or circulating fluids. Typical are the surfaces of boiler and heat exchanger tubes, transfer lines and storage tanks.

It is believed that the method and mixture disclosed in Reich were used commercially in the United States from the 1960s until 1985.

The invention claimed in Reich was predicated upon a discovery that a synergistic effect on the cleaning of scale and other adhesive foreign matter from such surfaces was obtained, if, as a cleaning solution, there was used an aqueous solution which contained between 0.2 and 20.0 percent by weight of a mixture of formic acid and citric acid, in which the ratio of citric acid to formic acid was between 1:3 and 6:1. In the tests reported in Reich, if amounts of the acid mixture were used that would have caused the formation of a sludgy precipitate had the same concentrations of either acid been used without the other, no sludgy precipitate was formed.

With reference to its FIG. 4, Reich teaches that under the conditions investigated by Reich, iron citrates precipitated from the solution if the weight ratio of formic acid to citric acid was more than slightly less than 1:6, and hydrated $Fe_2O_3$ precipitated from the solution if the weight ratio of formic acid to citric acid was more than slightly greater than 3:1.

Apparently, the apparatus used by Reich for the tests to determine the effects of using only formic acid, only citric acid, and the plotted points for mixtures of the two acids in the aqueous cleaning solution, in order to settle upon the mixture ratio range of the Reich invention was not an actual steam boiler or equivalent industrial apparatus, but rather a reflux condenser, apparently used without precautions to exclude air or to provide an inert or reducing atmosphere. Accordingly, the present inventor concludes from his reading of Reich that air was able to enter Reich's experiment; otherwise, he would not have been stabilizing $Fe_2O_3$, in which the iron is in the 3+ (ferric) oxidation state.

Introduction of air into utility boilers is uncharacteristic of at least present day chemical solution-based cleaning of iron oxide from internal surfaces of utility boilers and similar industrial equipment.

Reich further taught that the temperature of the aqueous solution while in contact with the scale for dissolving should be between 150° F. and its boiling point and, thereafter, at least 212° F., and preferably at least 200° F., while remaining in the vessel, that the solution contain between 0.1 and 1.0 percent by weight of a corrosion inhibitor described in any one of four enumerated prior U.S. patents, and/or contain 0.01 to 0.1 percent by weight of a wetting agent exemplified by a condensation product produced by condensing ethylene oxide with di-secondary butylphenol in a proportion of about 10 moles of ethylene oxide to 1 mole of di-secondary butylphenol.

For ensuring adequacy of disclosure without unnecessarily lengthening this text, the entire disclosure of the Reich patent is hereby included by reference.

For reasons unknown to the present inventor, the scale removing chemical of choice over the last several years, at least since 1985, has been a solvent based on a mixture of two parts glycolic acid and one part formic acid, by weight, typically totaling 3.0 percent by weight in an aqueous solution, with an inhibitor and scale removal accelerating agent.

Use of the aqueous glycolic acid-formic acid mixture solution is more expensive than use of the aqueous formic acid-citric acid solution within the concentration and proportion ranges and under the conditions taught in Reich. However, both are less expensive than using EDTA-based solvents. Cleaning times using the method taught in Reich tend to be comparable to those experienced using an aqueous glycolic acid-formic acid mixture solution as the solvent, e.g., from about 20 percent longer to about 20 percent shorter.

A strong motivation of the present inventor to re-explore the cleaning of drumless boilers using an aqueous solvent solution based on a mixture of formic acid and citric acid, was the prospect of savings in chemical costs.

Among the important criteria that a chemical cleaning service provider or customer typically may specify in connection with a contract for chemically cleaning the interior or a drumless boiler, are that the boiler tubes be cleaned within 30 hours or less of contact with solvent, at a temperature within the range between 150° F. and 200° F., that the solvent be adequately inhibited to prevent excessively attacking the bared metal of the boiler (e.g., a corrosion rate below 0.015 lb/ft$^2$/day; basically the higher the temperature, or the more the chromium in the alloy, or the greater the solvent concentration, or the higher the flow rate, the higher will be the necessary concentration of corrosion inhibitor, all other factors being equal), that it be possible to reduce the concentrations of metals dissolved into the solution to below 1 ppm by conventional waste treatment methods (e.g., using lime, NaOH, and air and/or $H_2O_2$), and that the solution be able to retain at least 0.7 percent by weight of iron in the 2+ (ferrous) state, for at least 24 hours.

In this document, well-known commercially available corrosion inhibitors are referred to by shorthand designations Inhibitor "A" and Inhibitor "B". Actual sources and chemical compositions are given as follows:

Inh A

An organic acid corrosion inhibitor, described as having proprietary organic amines, ethylene glycol and aromatic petroleum solvents.

Inh B

An organic acid corrosion inhibitor formulation based on U.S. Pat. No, 4,637,899.

SUMMARY OF THE INVENTION

During normal cleaning procedures for internal scale-encrusted steel surfaces of a utility boiler, a reducing atmosphere is maintained, and an aqueous solution containing about 4:1 to about 9:1 weight ratio of formic acid and citric acid, is placed in dissolving relation to the scale. The high F/C ratios hold more iron in solution than low F/C ratios, especially if the iron is kept in the 2+ oxidation state. The ability of the solution to hold dissolved iron is only slightly dependent on pH, so long as pH is maintained below 7.0. In addition, an oxidation stage is not required to remove dissolved iron to below 1 ppm from the solution, during waste treatment procedures using lime and NaOH.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
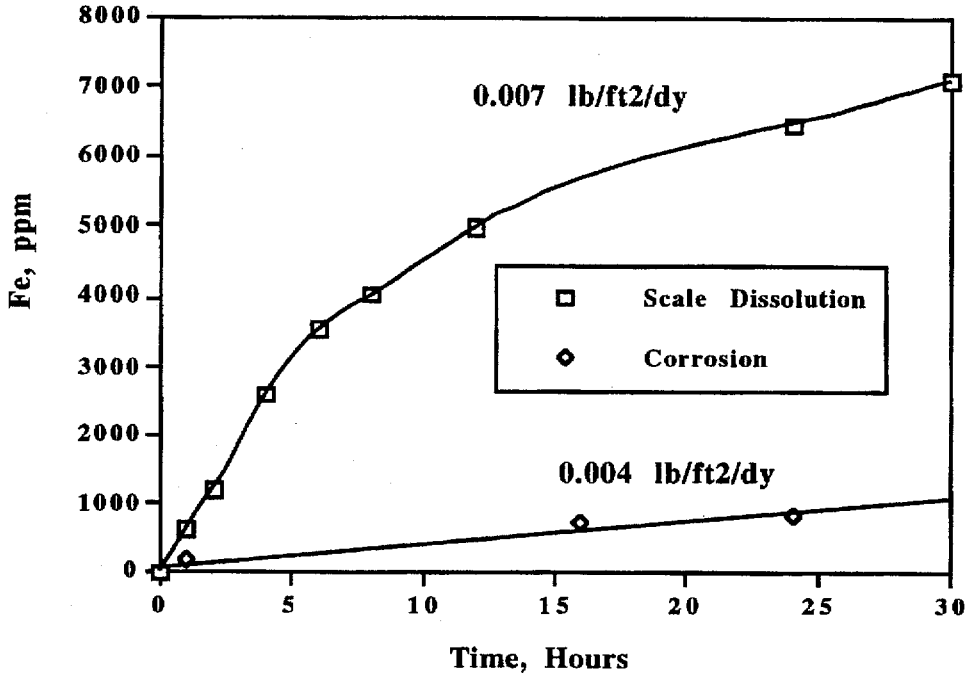
FIGS. 1–25 are graphical showings of results of tests of removal of magnetite from internal surfaces of drumless boilers using 4:1 to 9:1 mixture ratio formic acid-citric acid mixture aqueous solutions in the process of the present invention.

Scale dissolution tests were conducted using boiler tubing obtained from three operating drumless boilers. All of the tubes were milled to remove fireside scale prior to testing, leaving only scale that had deposited on the tube sides which, in use, had been in contact with boiler water and steam. The tubes were cut into 1-inch long rings, identified as follows:

Sample set 1 was rings of A213T2 boiler tubing from American Electric Power, Appalachian Power, Mountaineer Station, a Babcock & Wilcox Universal Pressure boiler. Prior to testing, the boiler from which these tubes were taken had most previously been cleaned in 1991, using a 4.0 percent by weight aqueous solution of 2 parts glycolic acid and 1 part formic acid. Scale loading (HCl weight loss) was 36 g/ft$^2$.

Sample set 2 was rings of A213T11 boiler tubing from Southern California Edison, Mohave Station, a Combustion Engineering supercritical unit. Its previous cleaning history was unknown. Scale loading (HCl weight loss) was 25 g/ft$^2$.

Sample set 3 was rings of A213T2 boiler tubing from Cincinnati Gas & Electric, Zimmer Plant, a Babcock & Wilcox supercritical boiler. Prior to testing, the boiler from which these tubes were taken had most previously been cleaned in May 1993, using a 3.0 percent by weight aqueous solution of 2 parts glycolic acid and 1 part formic acid, which also contained 0.25 percent by weight ammonium bifluoride (as a scale dissolution accelerating agent), and 0.2 percent by weight of Inh "B" as a corrosion inhibitor. The tubes used in sample set 3 were removed prior to the boiler being cleaned.

The nominal surface to volume ratio of the experiment was 0.5 cm$^{-1}$. The surfaces of sample sets 1 and 2, upon microscopic examination, were more pitted than those of sample set 3. Inhibitor film, thus, has more surface to cover in the former two instances than in the latter one.

In each of the tests, 350 ml of inhibited solvent mixture aqueous solution was placed in contact with four rings of the respective set in a standard Parr bomb, having an internal volume of 1000 ml, heated to 150° F. or 200° F., pressurized to 100 psig with $N_2$, and stirred at 70 rpm. The respective solution was sampled for [Fe], for 30 hours, whereupon, the tube rings were removed and cleaning effectiveness was determined visually. Corrosion tests were then run on the cleaned tubes, using fresh solvent.

The presently preferred inhibitors are Inh "A" which is added to the solution to an extent of between 0.1 and 1.0 volume percent, preferably 0.2–0.3 volume percent, and Inh "B", which is added to the solution to an extent of between 0.1 and 1.0 volume percent, preferably 0.2–0.3 volume percent. Alternatives include other organic acid inhibitors which will give a corrosion rate of <0.015 lb/ft$^2$/day in the following test.

Four steel corrosion test coupons are placed in a Teflon™ holder and then placed in a 1000 ml Parr bomb. Enough of the inhibited cleaning solvent is added to the bomb to give a surface/volume ratio of at least 0.6 cm$^{-1}$. The bomb is stirred at 70 rpm for 6 hours at the test temperature. At least three different metals should be tested, including boiler plate, mild steel (such as 1018 CS) and one low alloy steel such as A213T11 (1¼ percent Cr).

Other additives could be included as follows:

Ammonium bifluoride or less than 1 percent hydrofluoric acid as scale dissolution accelerators.

Cleaning time was estimated from noting the leveling point in [Fe] versus time curves, and corrosion rate was calculated from the difference in [Fe] at the leveling point and finally. As a check, corrosion rate also was calculated from 24 hours of exposure of cleaned tubes to fresh solvent solution.

Used cleaning solutions were treated with 1 percent lime, and enough NaOH to raise the pH to 12.8, after which air was blown through the mixture until the resulting slurry was red brown in color. If at least a 2:1 mole ratio of lime to Fe was used, the final [Fe] was less than 1 ppm. If concentration of chromium in the used cleaning solution is less than 20 ppm, it also will be reduced to less than 1 ppm, by the above-described treatment. $H_2O_2$ can be used in addition to or in place of air, for lowering concentrations of Fe, Cr, Ni and other commonly encountered metals, to less than 1 ppm.

The bomb tests are believed to reliably simulate the actual cleaning of a drumless boiler using a cleaning solution of the same composition. However, for those not familiar with how such a boiler would be cleaned using the process of the present invention, the generic cleaning process is briefly described as follows:

A utility power boiler consists of thousands of feet of tubing (½ inch to about 1¼ inches in diameter) that surround the fire box. The steam to drive the turbines that generate electricity is produced inside the tubes. The surface/volume ratio of a drumless boiler is about 1.0 $cm^{-1}$. During the cleaning process, the boiler tubing is filled with water, and then the cleaning acids and inhibitors are injected into boiler. Frequently, there is a chemical cleaning tank provided to facilitate injection of the cleaning chemicals. To achieve the desired dissolution of the magnetite, the solvent must be circulated through the tubes and be heated from about 150° F. to about 200° F. to speed the dissolution reactions. High volume pumps are provided by the cleaning contractor if the utility does not have the capability to circulate the cleaning solution. Heat usually is provided by circulating the cleaning solution through a heat exchanger. During the cleaning process, all vents are closed so that air is excluded from entering the system. Hydrogen generated during the process (from corrosion), insures that the cleaning takes place under reducing conditions. The progress of the job will be monitored by determining the concentration of iron, free (unused) acid and pH (which will rise as the acid is spent). When the iron concentrations, free acid and pH have stabilized, the solvent is drained to a holding tank, and the boiler is flushed with very clean water. This usually is followed by a neutralizing rinse of ammoniated water, frequently containing hydrazine or a hydrazine derivative. This process leaves the metal surfaces in a passivated condition.

All of the cleaning solvent and rinses must be treated to remove heavy metals or otherwise given disposal treatments in compliance with local and federal laws.

Sample Set 1.

For comparative purposes, a 3.0 percent aqueous solution of 2 parts glycolic acid and 1 part formic acid, containing 0.2 percent Inh "B" as a corrosion inhibitor, was found to clean these tube rings within 8 hours at 200° F., with an acceptably low corrosion rate of 0.0045 $lb/ft^2/day$.

Also, for comparative purposes, a 2.0 percent aqueous solution of 2 parts formic acid and 1 part citric acid, inhibited with either 0.1 to 0.2 percent Inh "A" or 0.1 percent to 0.2 percent Inh "B" was found to clean these tube rings within 12 hours at temperatures between 150° F. and 200° F., with an acceptably low corrosion rate of 0,004 to 0.020 $lb/ft^2/day$.

Also, for comparative purposes, a 2.0 percent aqueous solution of formic acid, inhibited with 0.2 percent Inh "B" was found to leave about 5 percent of the original scale on the tube rings at 30 hours, and corrosion rate was 0.008 $lb/ft^2/day$.

Figure 2:
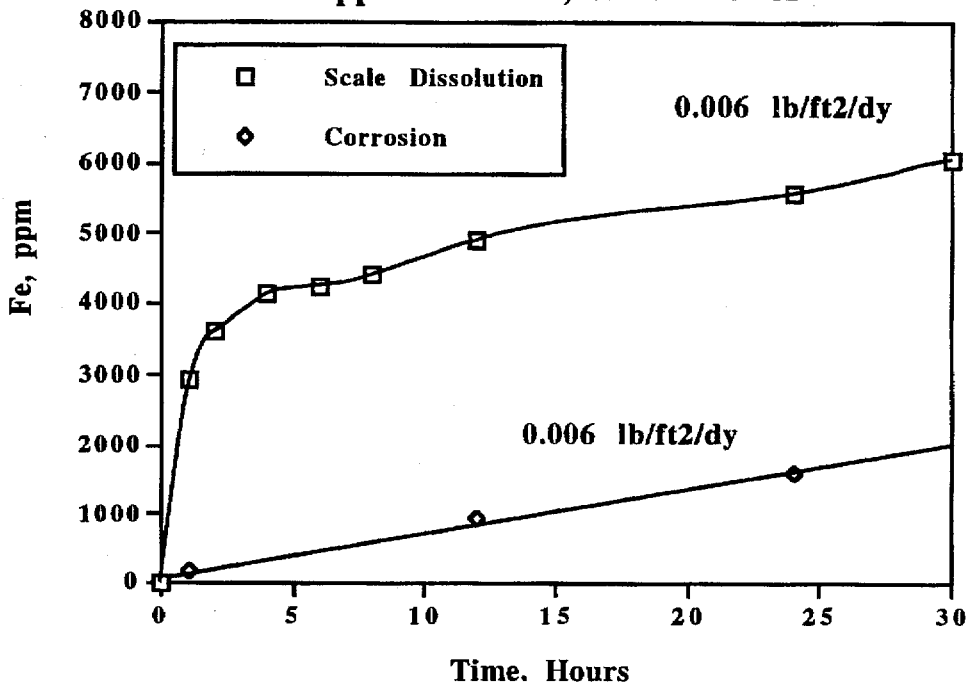
Figure 3:
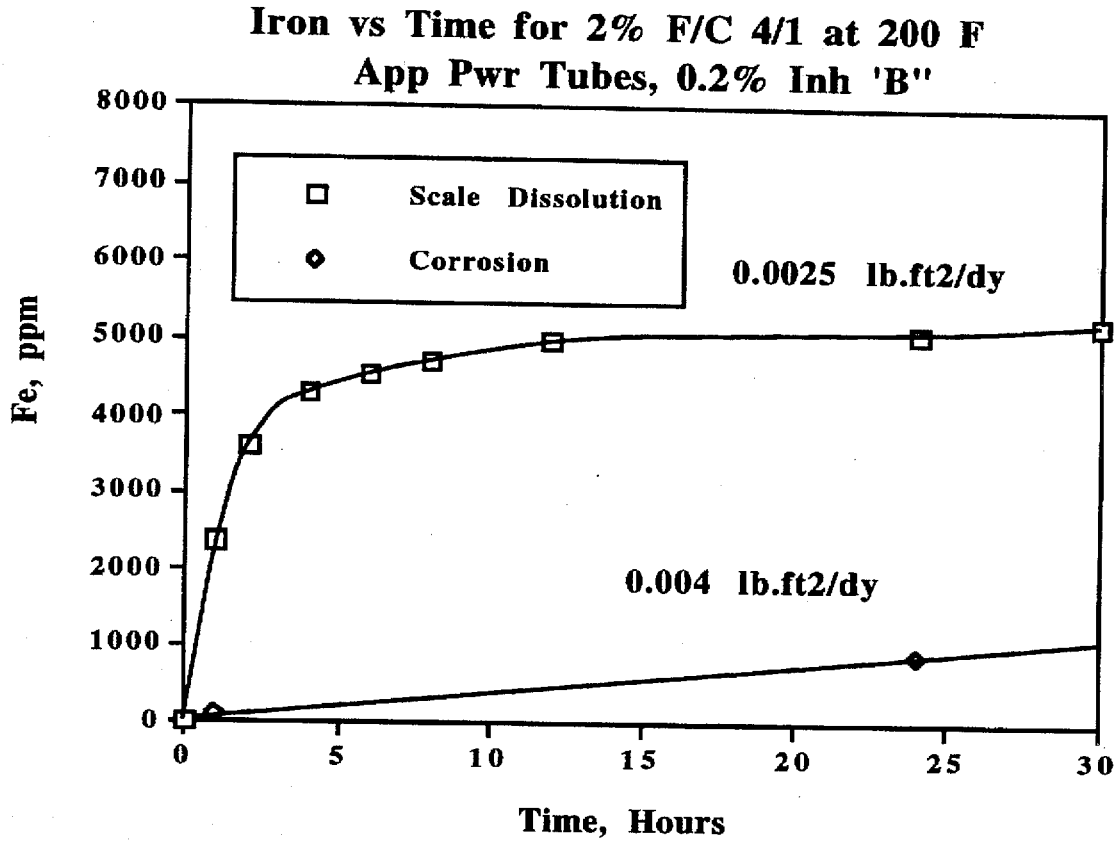

FIGS. 1, 2 and 3, respectively, show the results of use in the process of the invention of 2.0 percent 4:1 formic acid-citric acid mixture aqueous solution, respectively, at 150° F. using 0.1 percent Inh "B" as inhibitor (FIG. 1), at 200° F. using 0.2 percent Inh "A" as inhibitor (FIG. 2) and at 200° F. using 0.2 percent Inh "B" as inhibitor. At 200° F., Inh "B" was the inhibitor of choice.

Figure 4:
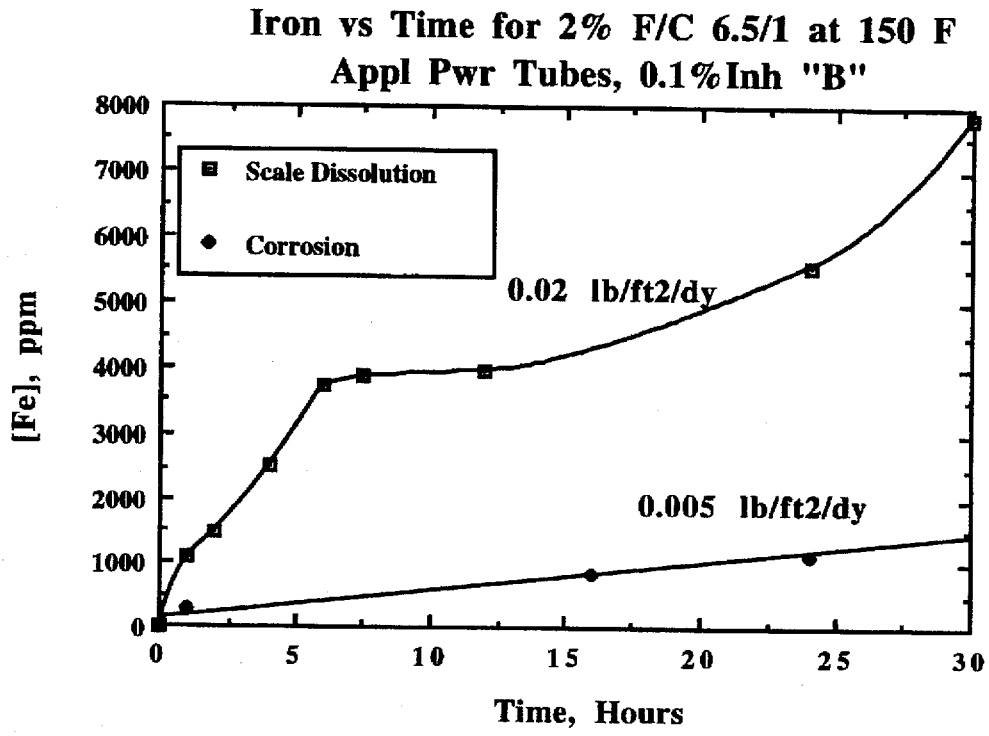
Figure 5:
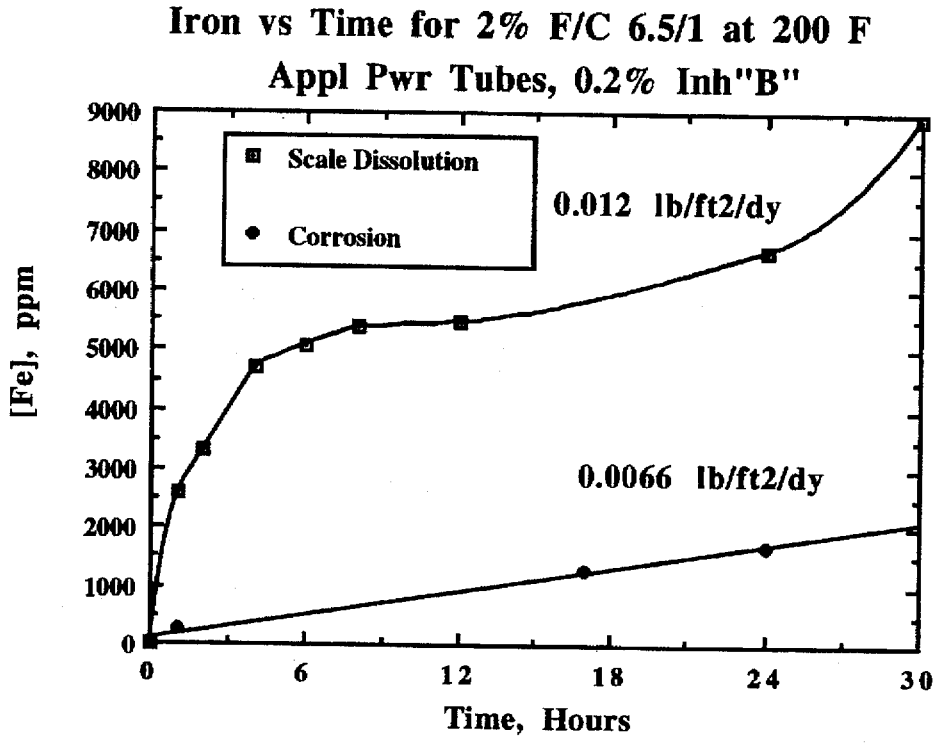

FIGS. 4 and 5, respectively, show the results of use in the process of the invention of 2.0 percent 6.5:1 formic acid-citric acid mixture aqueous solution, respectively, at 150° F. using 0.1 percent Inh "B" as inhibitor and at 200° F. using 0.2 percent Inh "B" as inhibitor.

Figure 6:
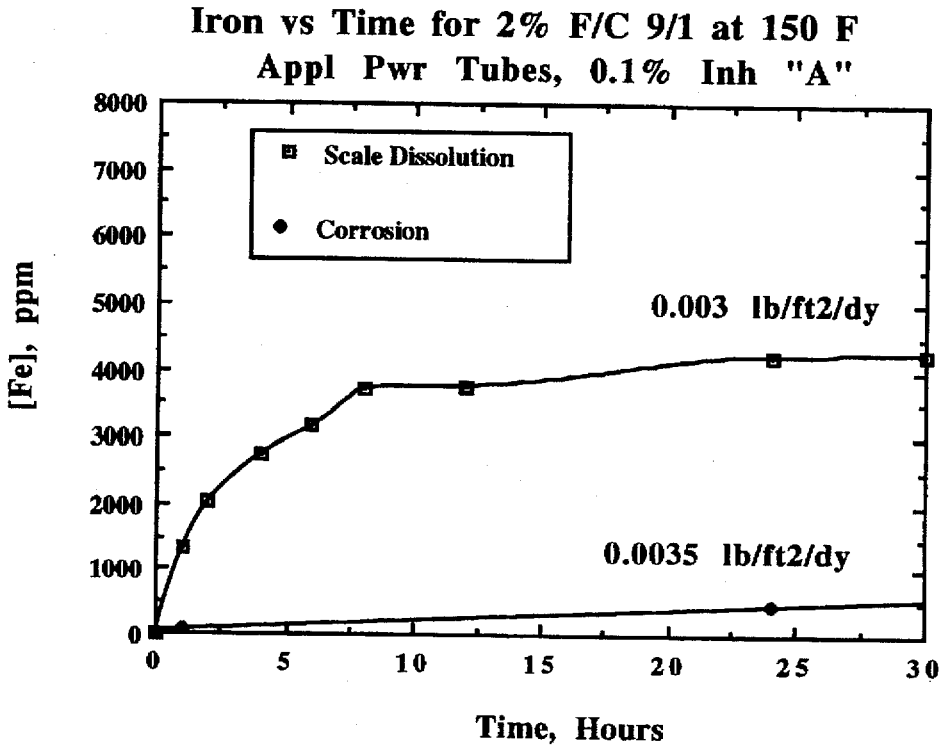
Figure 7:
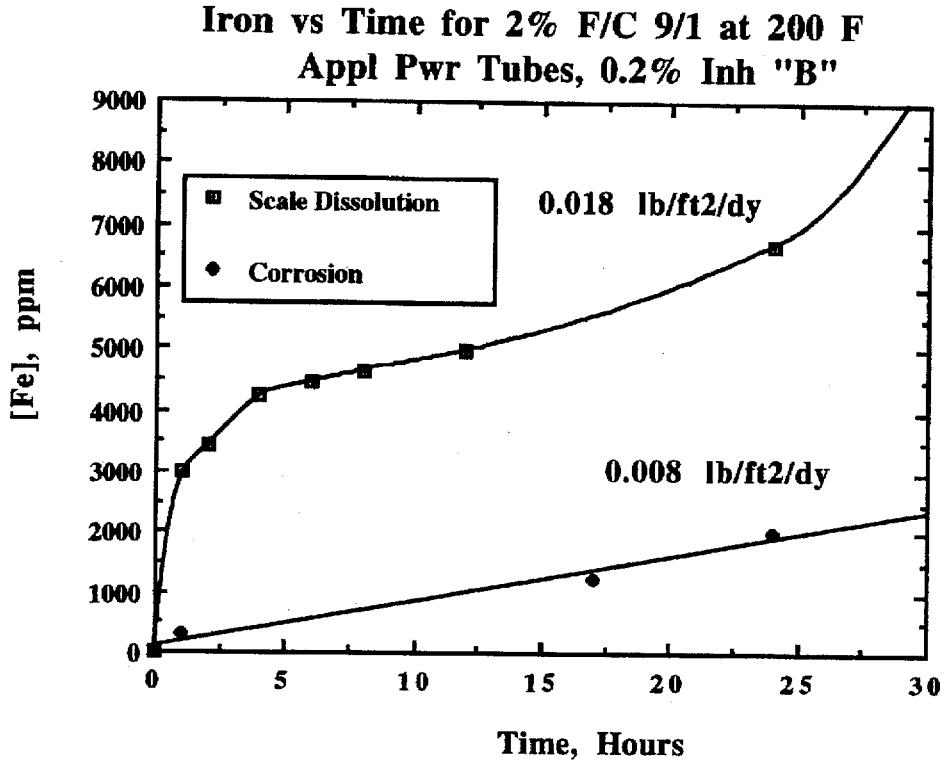
Figure 8:
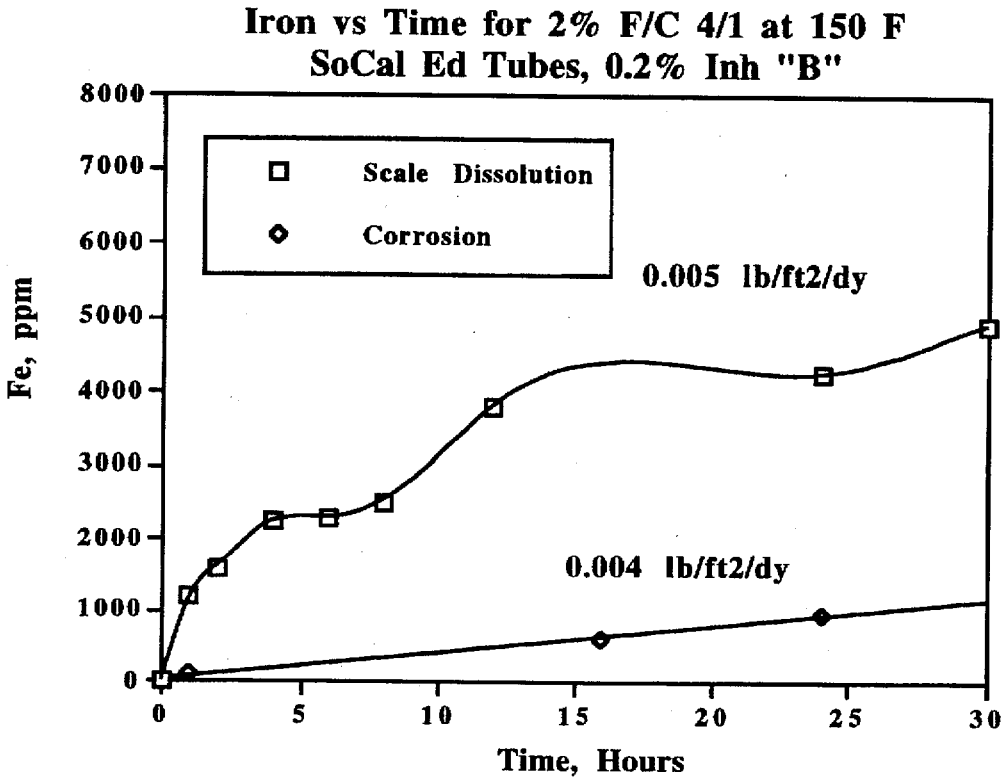
Figure 9:
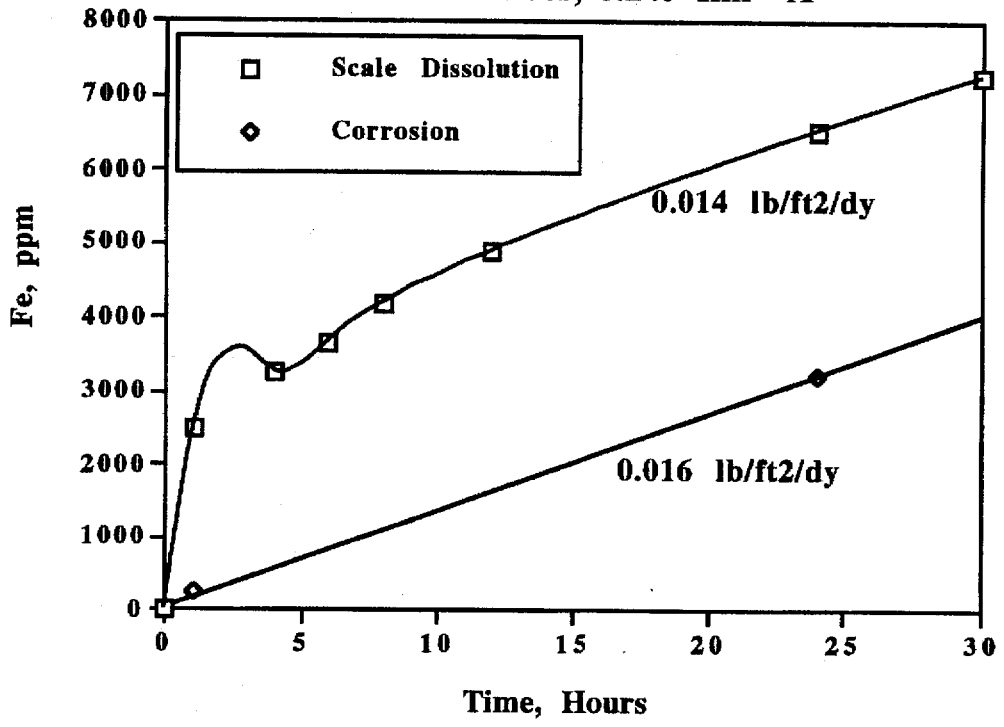
Figure 10:
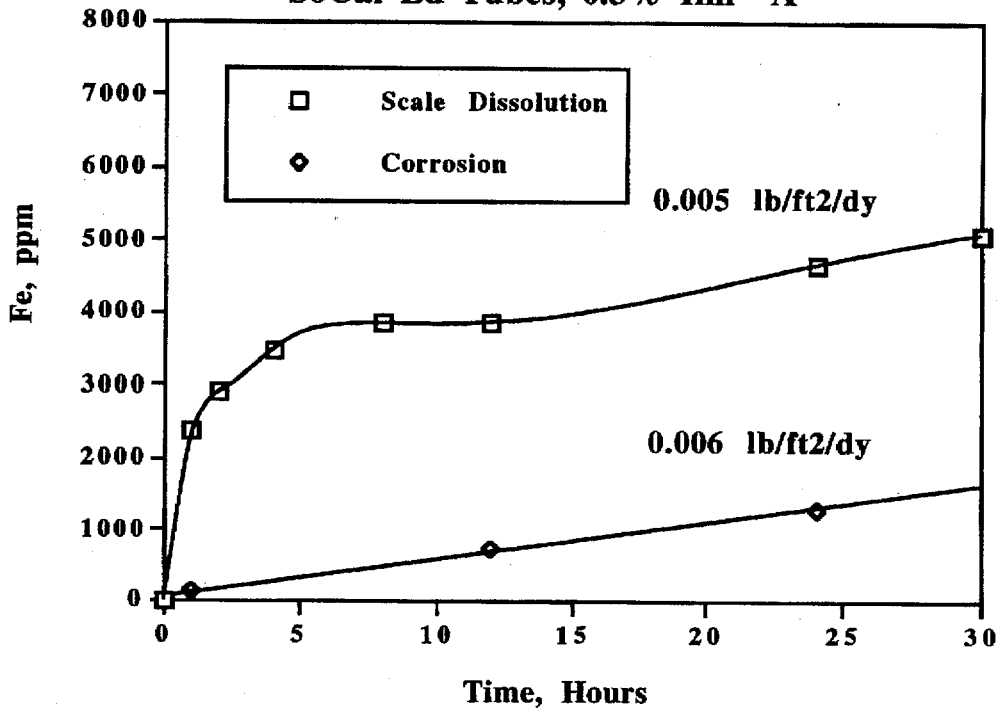
Figure 11:
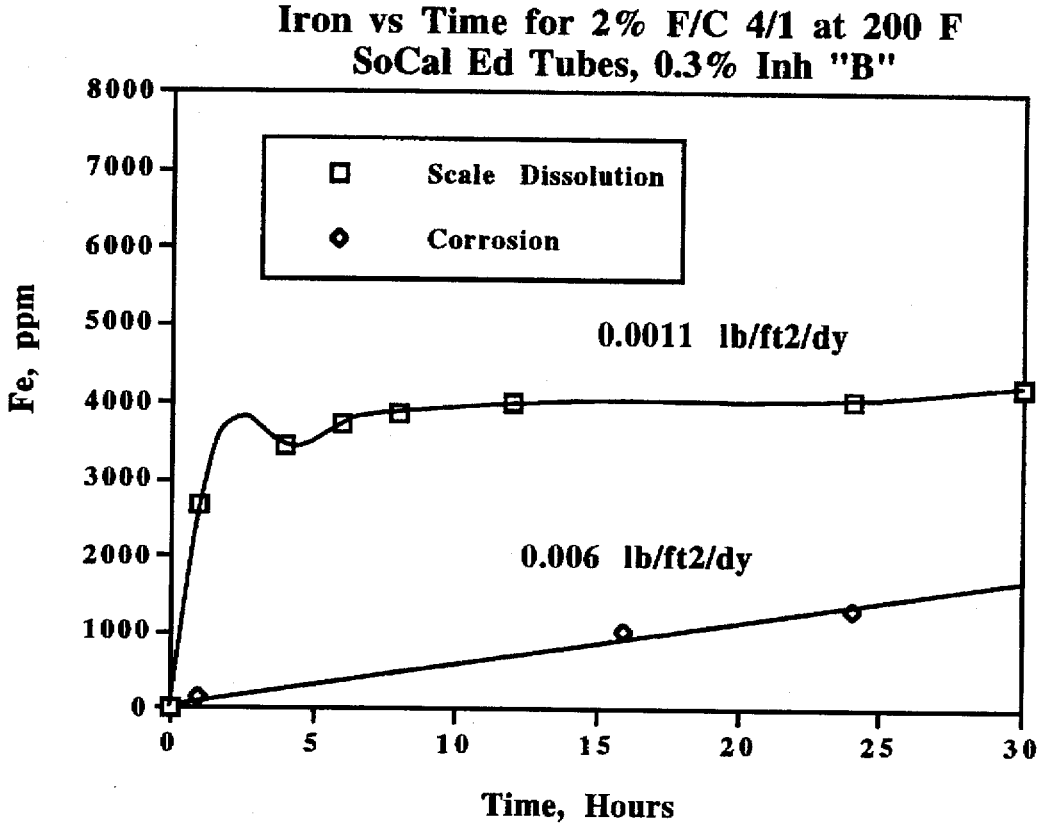

FIGS. 6 and 7, respectively, show the results of use in the process of the invention of 2.0 percent 9:1 formic acid-citric acid mixture aqueous solution, respectively, at 150° F. using 0.1 percent Inh "A" as inhibitor, and at 200° F. using 0.2 percent Inh "B" as inhibitor.

Sample Set 2.

For comparative purposes, a 3.0 percent aqueous solution of 2 parts glycolic acid and 1 part formic acid, containing 0.2 percent Inh "B" as a corrosion inhibitor, at 200° F. was found to clean these tube rings. This amount of inhibitor was insufficient (corrosion rate estimated at 0.024 $lb/ft^2/day$), making it impossible to determine an endpoint for scale removal. Accordingly, retesting was done, with the amount of inhibitor raised to 0.3 percent, which gave lower corrosion rate, and an estimated cleaning time of 10 hours.

Also, for comparative purposes, a 2.0 percent aqueous solution of 2 parts formic acid and 1 part citric acid, inhibited with 0.2 percent Inh "B" was found to clean these tube rings at 150° F. within 12 hours, with a corrosion rate of 0.003 $lb/ft^2/day$, and inhibited with 0.2 percent Inh "A" was found to clean these tube rings at 200° F. within 12 hours, with a corrosion rate of 0.018 $lb/ft^2/day$, and inhibited with 0.2 percent Inh "B" was found to clean these tube rings at 200° F. within 12 hours, with a corrosion rate of 0.014 $lb/ft^2/day$, and inhibited with 0.3 percent Inh "A" was found to clean these tube rings at 200° F. within 12 hours. Inhibitor loadings of 0.3 percent at 200° F. and 0.2 percent at 150° F. were required to give well-defined endpoints for the cleaning process, as well as low corrosion rates. The two inhibitors were equally effective.

FIGS. 8–11, respectively, show the results of use in the process of the invention of 2.0 percent 4:1 formic acid-citric acid mixture aqueous solution, respectively, at 150° F. using 0.2 percent Inh "B" as corrosion inhibitor, at 200° F. using 0.2 percent Inh "A" as corrosion inhibitor, at 200° F. using 0.3 percent Inh "A" as inhibitor, and at 200° F. using 0.3 percent Inh "B" as corrosion inhibitor.

From FIGS. 8–11, it can be seen that, when adequately inhibited (0.2 percent at 150° F. and 0.3 percent at 200° F.), cleaning times of 12 hours at 150° F. and 8 hours at 200° F. are achieved, with effectiveness comparable to that of using the inhibited 3.0 percent glycolic-formic acid solution mixture at 200° F.

Figure 12:
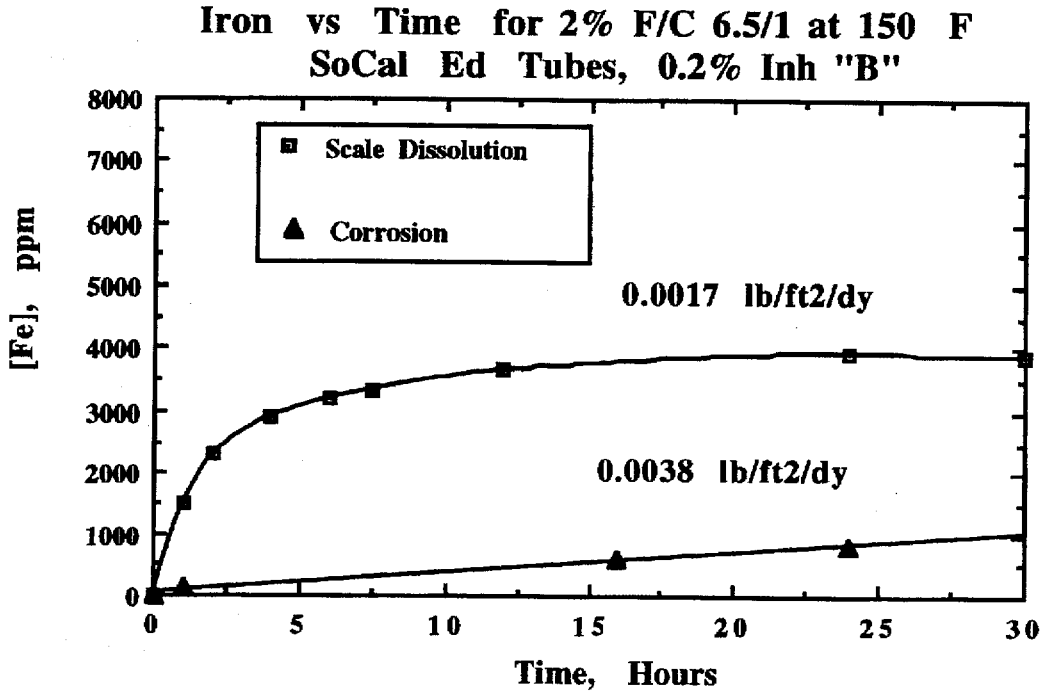
Figure 13:
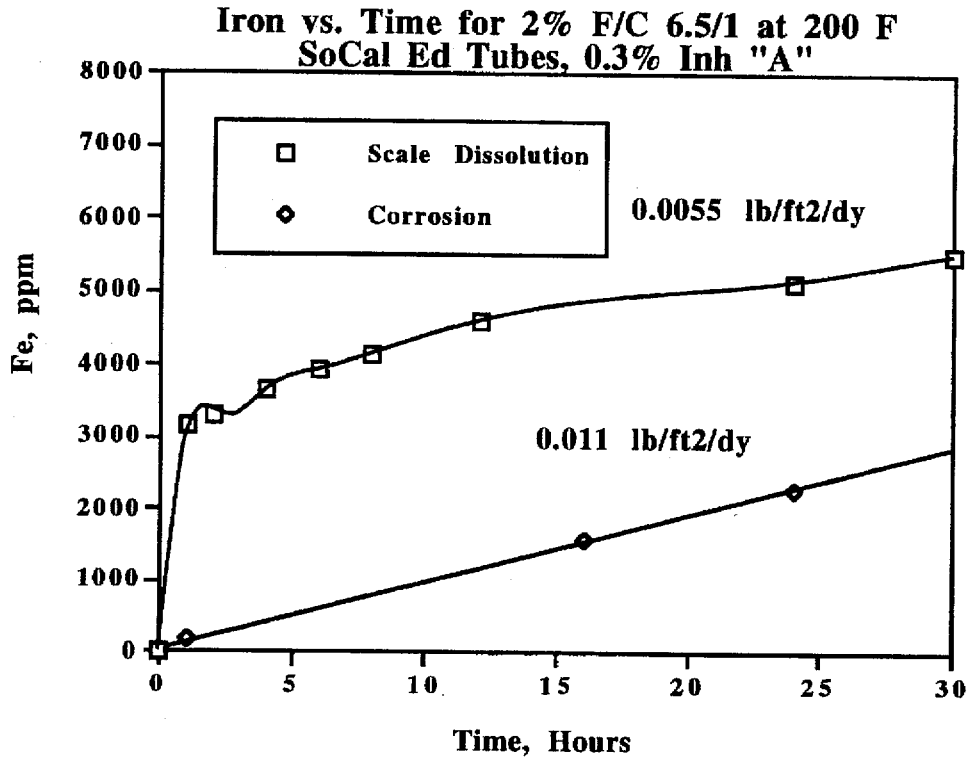
Figure 14:
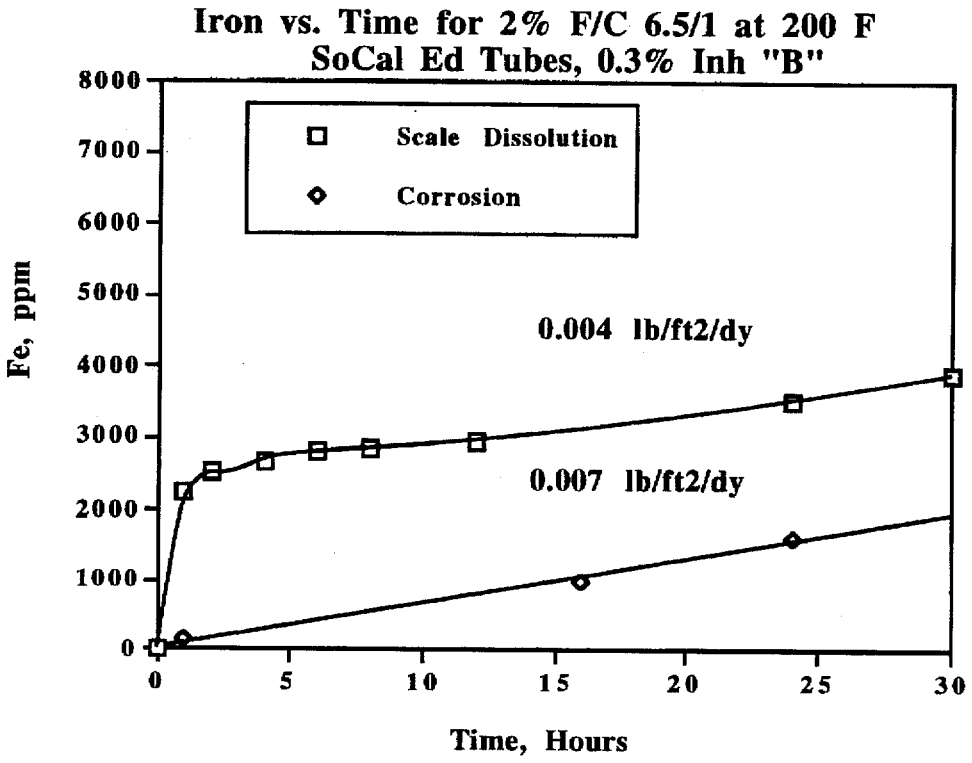

FIGS. 12, 13 and 14, respectively, show the results of use in the process of the invention of 2.0 percent 6.5:1 formic acid-citric acid mixture aqueous solution, respectively, at 150° F. using 0.2 percent Inh "B" as corrosion inhibitor, at 200° F. using 0.3 percent Inh "A" as corrosion inhibitor, and at 200° F. using 0.3 percent Inh "B" as corrosion inhibitor.

Figure 15:
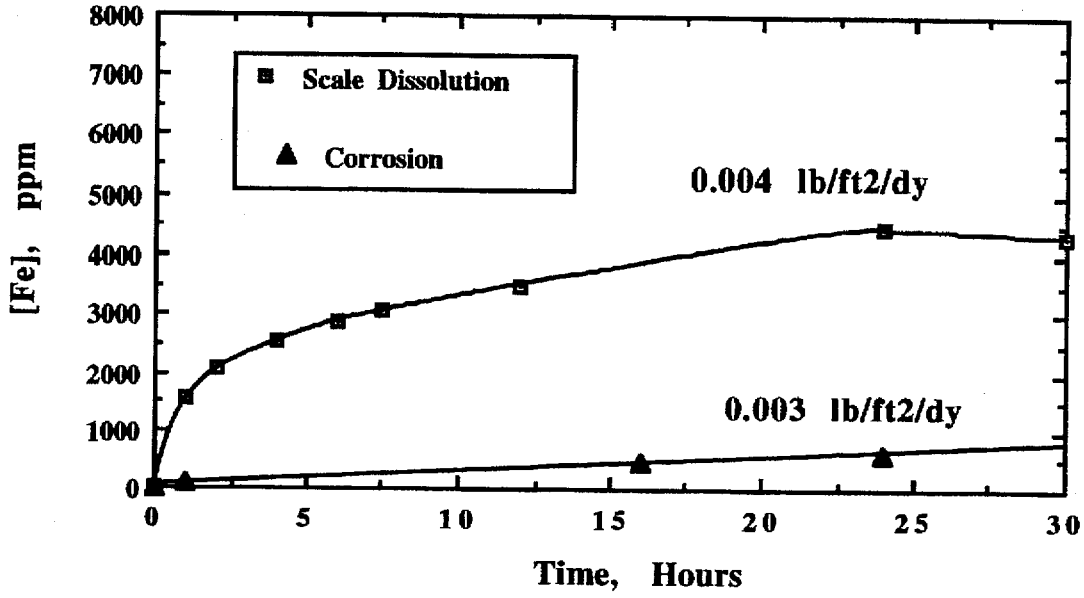
Figure 16:
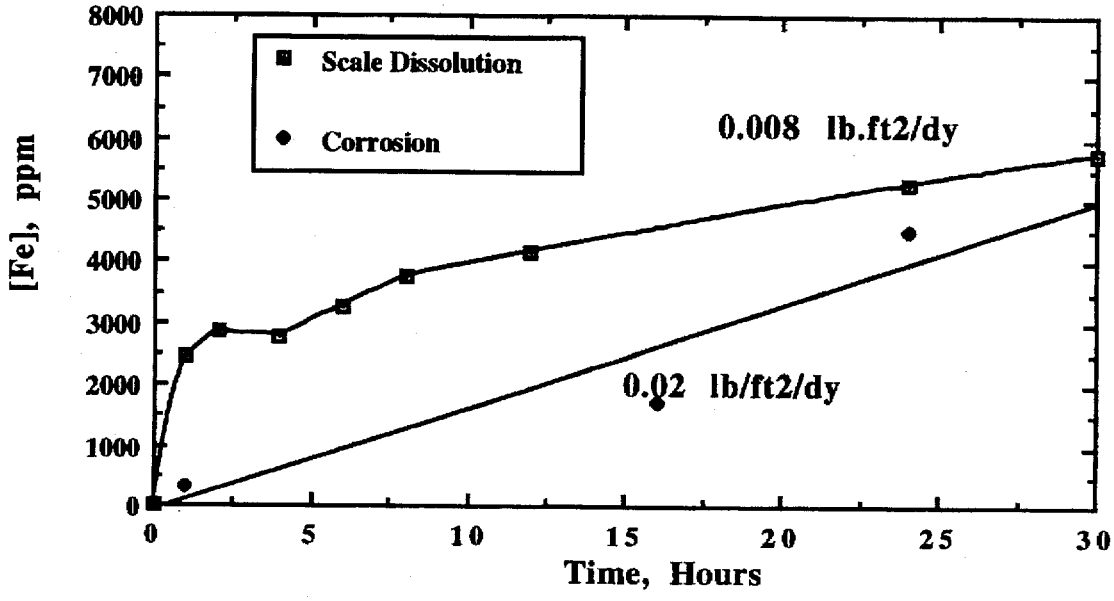
Figure 17:
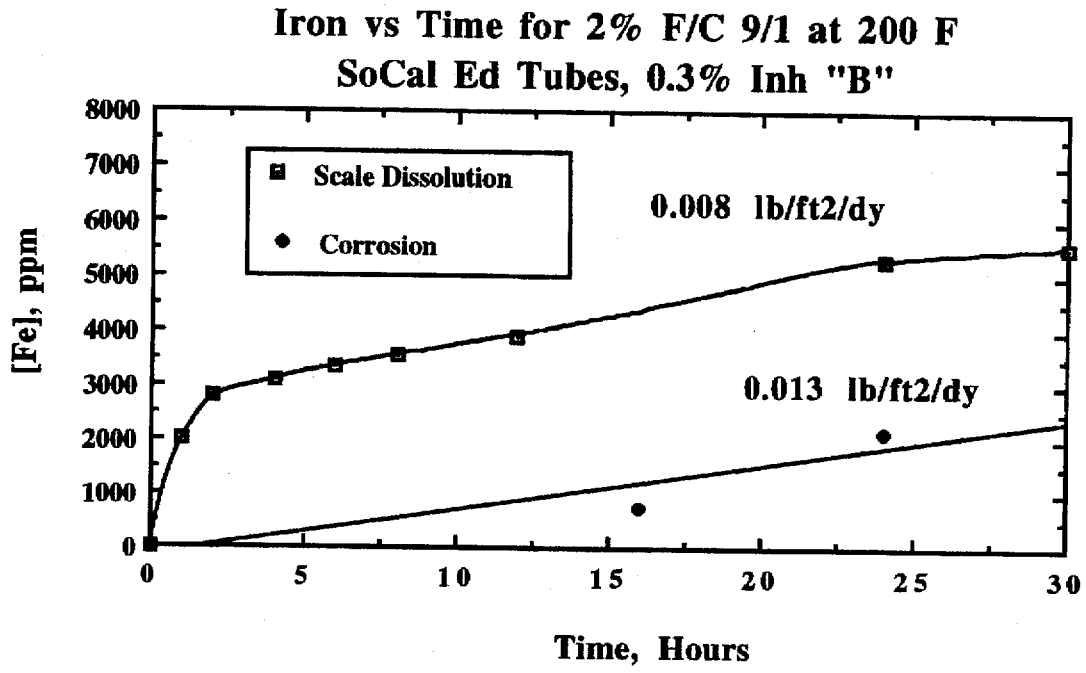

FIGS. 15, 16 and 17, respectively, show the results of use in the process of the invention of 2.0 percent 9:1 formic acid-citric acid mixture aqueous solution, respectively, at 150° F. using 0.2 percent Inh "B" as corrosion inhibitor, at 200° F. using 0.3 percent Inh "A" as corrosion inhibitor, and at 200° F. using 0.3 percent Inh "B" as corrosion inhibitor.

All of the solvent solutions of FIGS. 12–17 cleaned the tube ring samples, with cleaning times of 12 hours at 150° F. and 6 to 8 hours at 200° F. Necessary inhibitor loadings were 0.1 percent higher than for sample sets 1 and 3, due to the greater chromium in sample set 2.

Sample Set 3.

For comparative purposes, a 3.0 percent aqueous solution of 2 parts glycolic acid and 1 part formic acid, containing 0.2 percent Inh "B" as a corrosion inhibitor, was found to clean these tube rings within 8 hours at 200° F.

Also, for comparative purposes, a 2.0 percent aqueous solution of 2 parts formic acid and 1 part citric acid containing 0.1 percent Inh "B" as a corrosion inhibitor, was found to clean these tube rings within 12 hours at 150° F., and containing 0.2 percent Inh "B" as a corrosion inhibitor, was found to clean these tube rings within 6 hours at 200° F.

Figure 18:
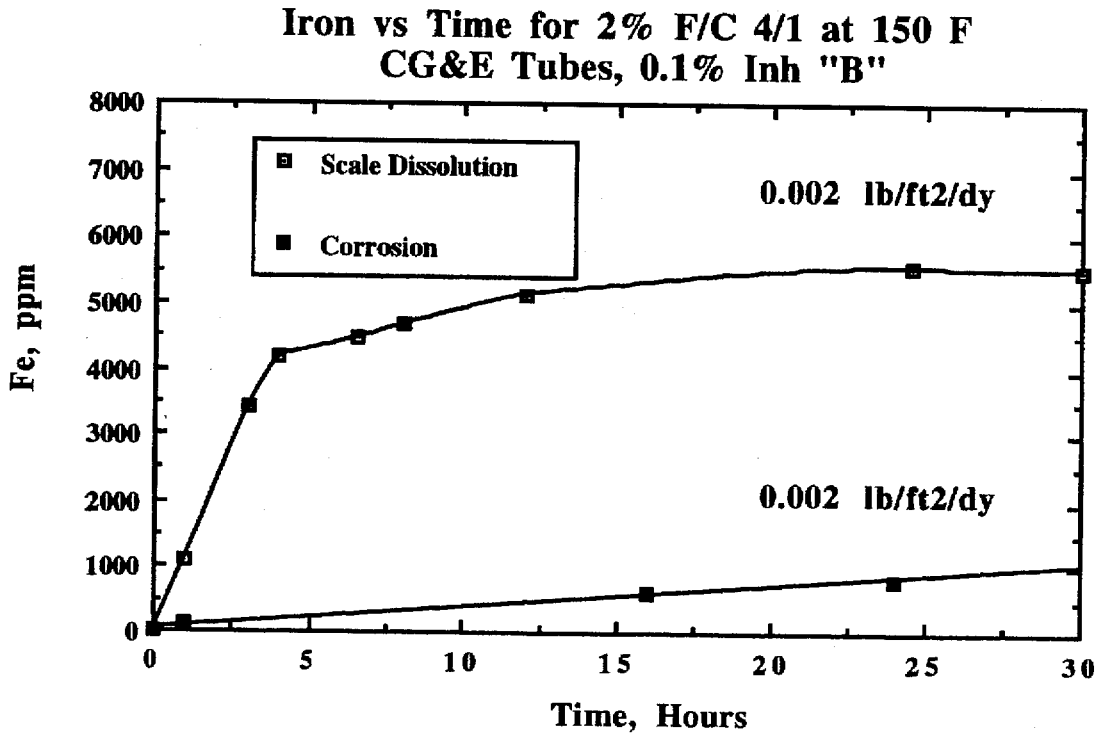
Figure 19:
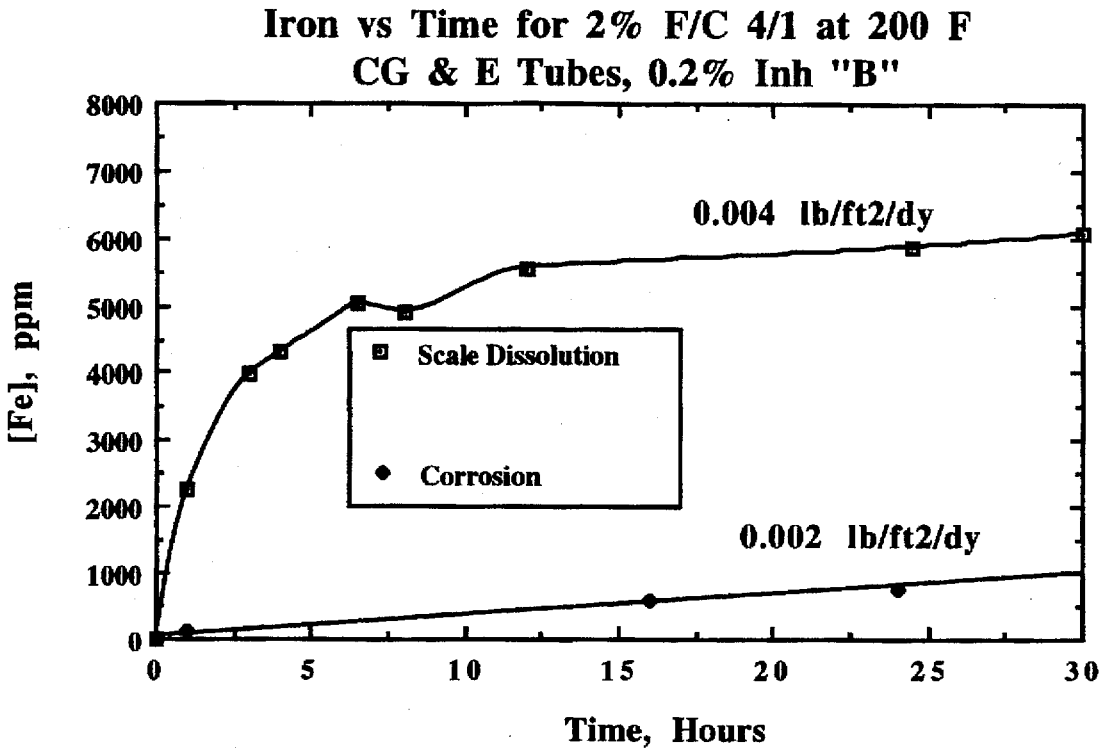

FIGS. 18 and 19, respectively, show the results of use in the process of the present invention of 2.0 percent 4:1 formic acid-citric acid mixture aqueous solution, respectively, at 150° F. using 0.1 percent Inh "B" as corrosion inhibitor, and at 200° F. using 0.2 percent Inh "B" as corrosion inhibitor. Respective cleaning times were 12 hours and 6 hours.

Figure 20:
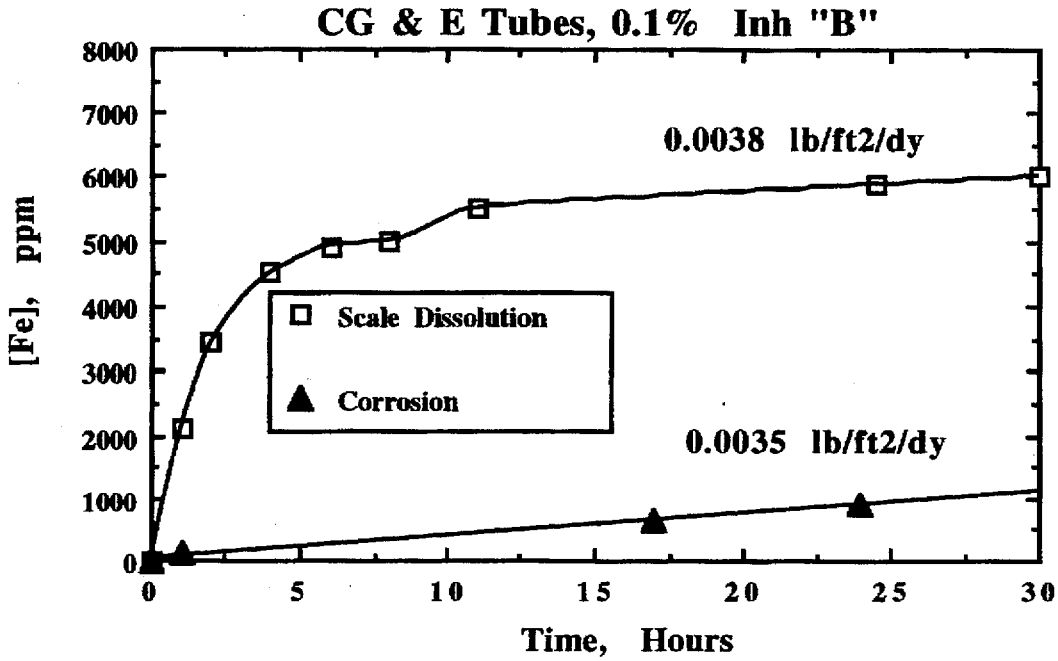
Figure 21:
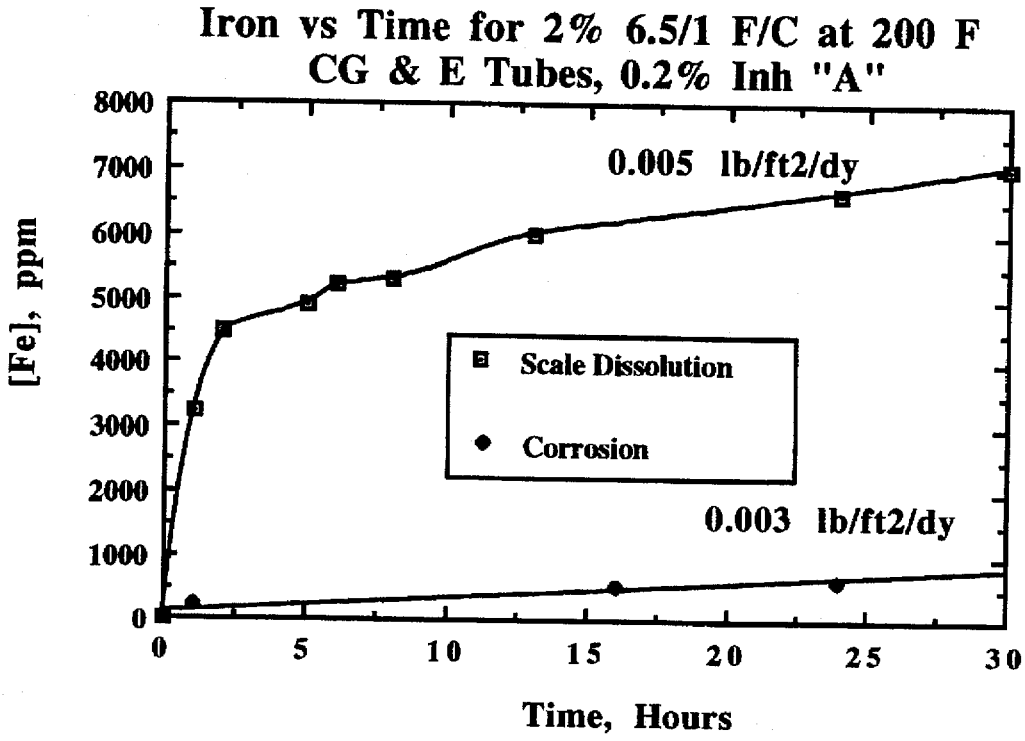
Figure 22:
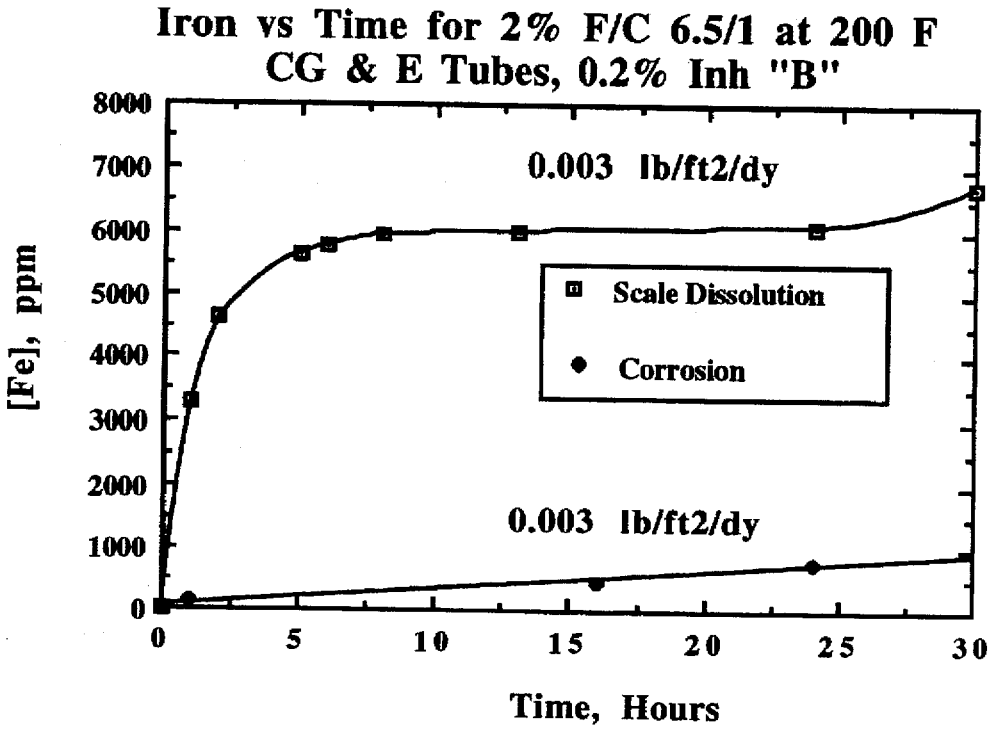

FIGS. 20–22, respectively, show the results of use in the process of the present invention of 2.0 percent 6.5:1 formic acid-citric acid mixture aqueous solution, respectively, at 150° F. using 0.1 percent Inh "B" as corrosion inhibitor, at 200° F. using 0.2 percent Inh "A" as corrosion inhibitor, and at 200° F. using 0.2 percent Inh "B" as corrosion inhibitor. Respective cleaning times were 10 hours, 6 hours and 6 hours.

Figure 23:
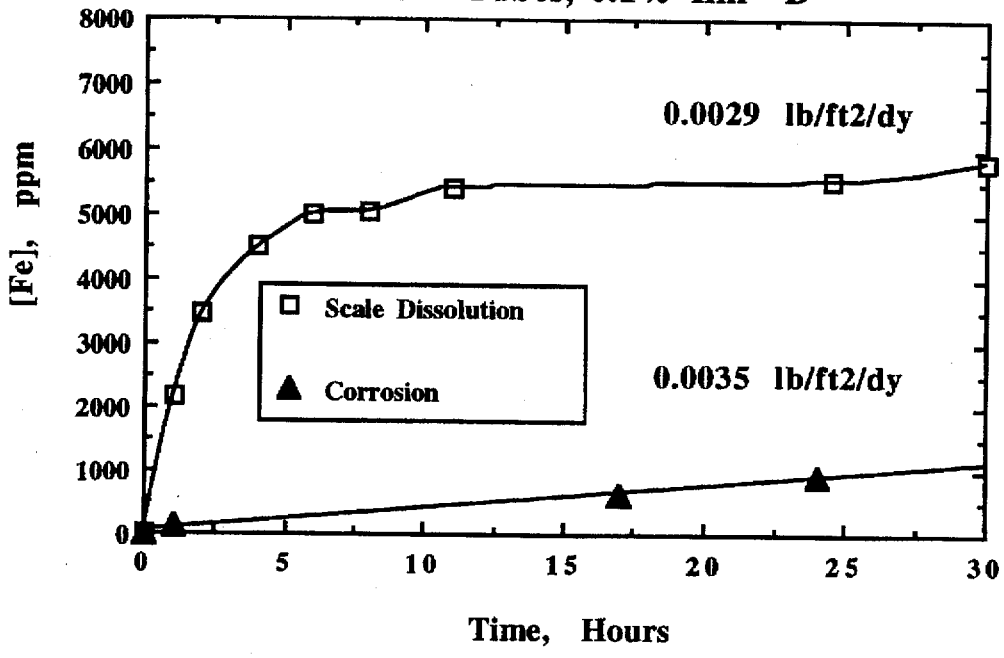
Figure 24:
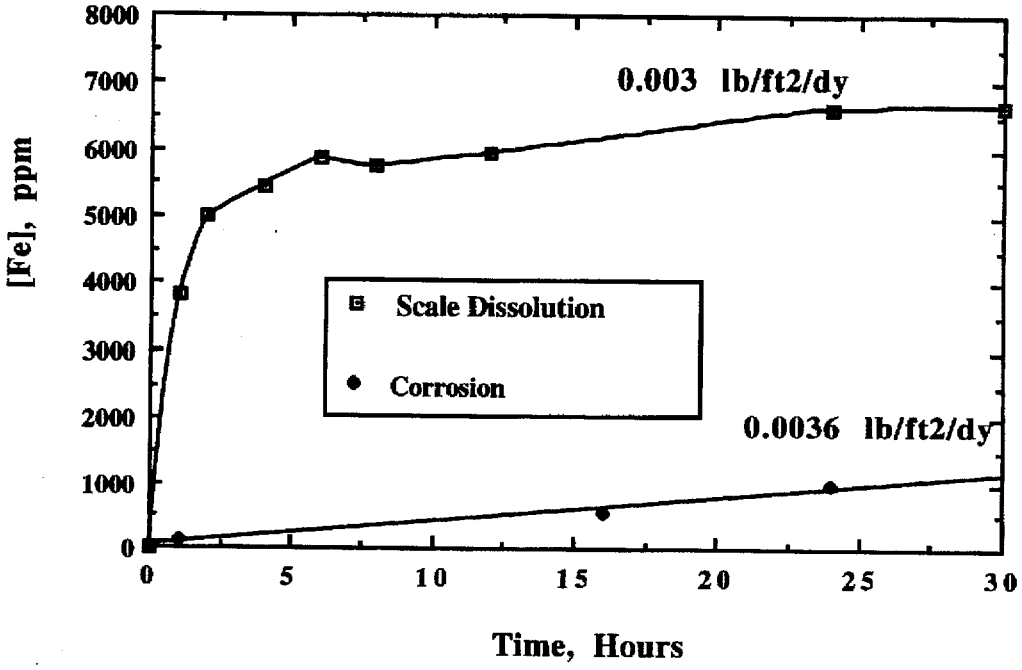
Figure 25:
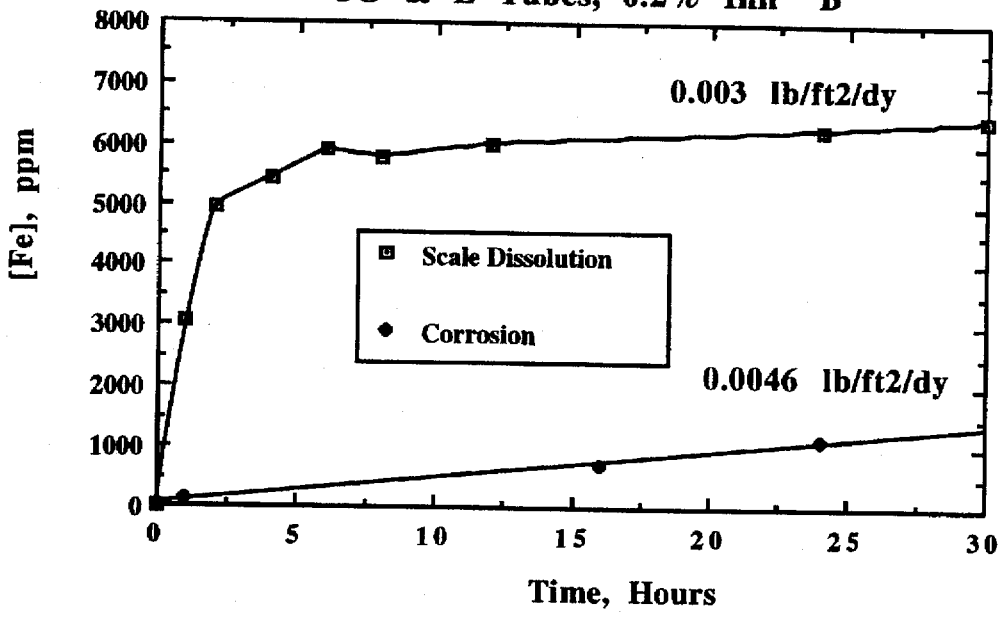

FIGS. 23–25, respectively, show the results of use in the process of the present invention of 2.0 percent 9:1 formic acid-citric acid mixture aqueous solution, respectively, at 150° F. using 0.1 percent Inh "B" as corrosion inhibitor, at 200° F. using 0.2 percent Inh "A" as corrosion inhibitor, and at 200° F. using 0.2 percent Inh "B" as corrosion inhibitor. Respective cleaning times were 8 hours, 6 hours and 6 hours.

Figure 26:
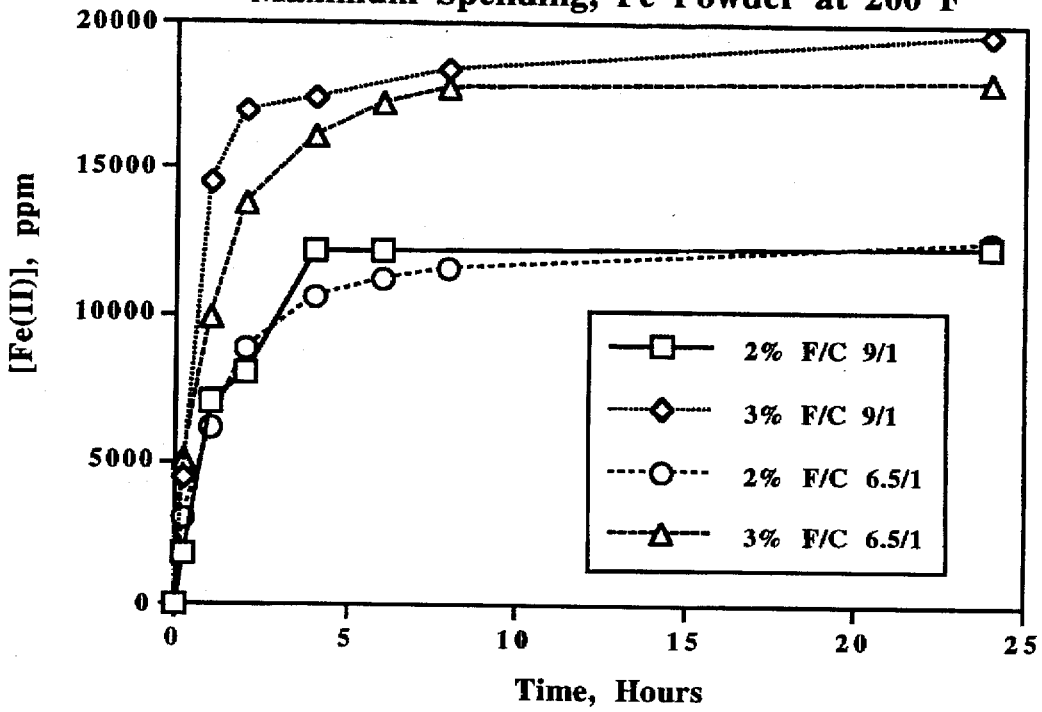
FIG. 26 graphically shows the capacity of 2 percent and 3 percent 6.5:1 and 9:1 formic acid-citric acid mixture aqueous solutions to hold iron in the ferrous state, as determined in connection with the present invention, the values shown being in line with the total acidity (i.e., [$H^+$]) of the solvents.
Figure 27:
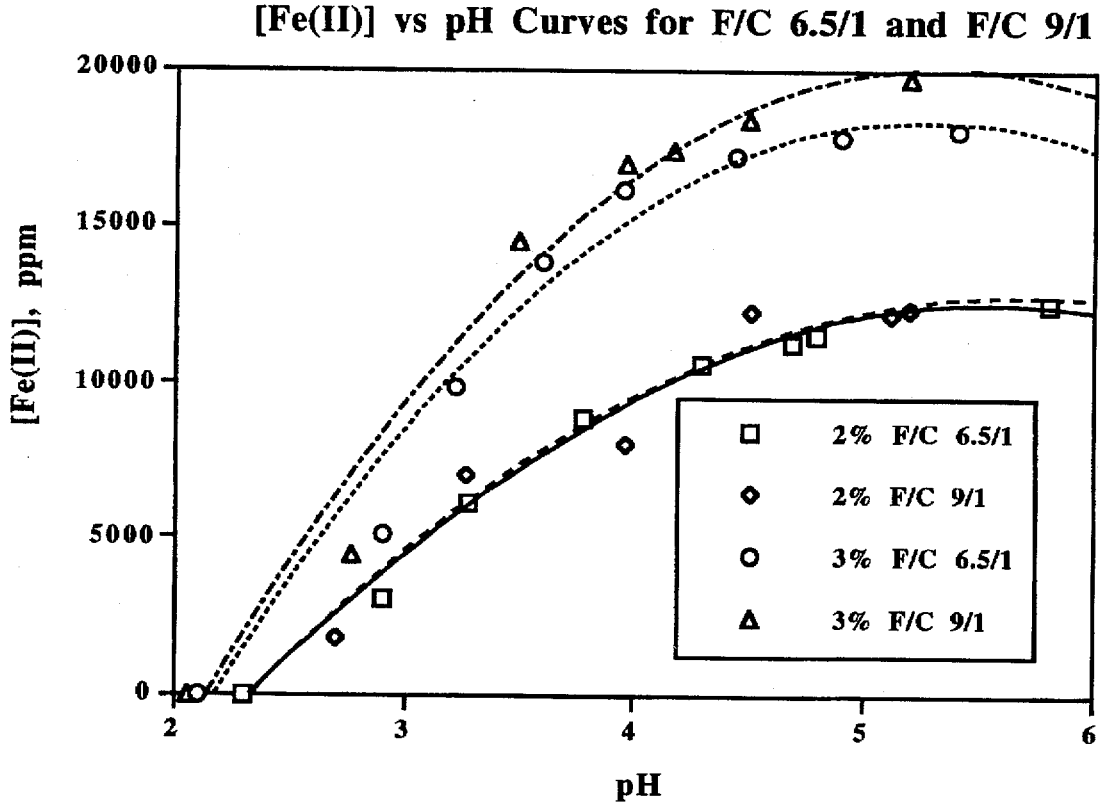
FIG. 27 graphically shows that no precipitation of iron hydroxide or loss of iron concentration from the spent solutions was observed, within 24 hours, for a pH below 7, air being excluded.

FIG. 26 shows the capacity of 2 percent and 3 percent 6.5:1 and 9:1 formic acid-citric acid mixture aqueous solutions to hold iron in the ferrous state, as determined in connection with the present invention, the values shown being in line with the total acidity (i.e., $[H^+]$) of the solvents. FIG. 27 shows that no precipitation of iron hydroxide or loss of iron concentration from the spent solutions was observed, within 24 hours, for a pH below 7, air being excluded.

The present inventor has concluded from the tests, that when pH is maintained below 7.0 and air is excluded, in a reducing atmosphere, cleaning efficiencies of formic acid-citric acid mixed solvent in aqueous solution in a proportion range of between 4:1 and 9:1 are essentially the same as for 3 percent 2:1 aqueous solutions of glycolic acid and formic acid, and essentially the same as for the 2:1 aqueous solutions of formic acid-citric acid of the Reich patent (with the exception of the higher rate for the 4:1 aqueous solution in sample set 1). The potential savings in inhibitor costs when cleaning at lower temperatures needs to be balanced against the cost of increased time at the job site for particular practices of the process. At present prices, cost savings based on chemicals used in 3 percent mixed glycolic and formic acid solutions, and 2 percent mixed formic acid and citric acid solutions can be about 40 percent, and the oxidation step that is needed for removing metals from the spent cleaning solution in the former instance is avoided in the latter.

The formic acid-citric acid ratio of 4:1 was acceptable for all three sample sets, whereas the ratio of 6.5:1 was fully acceptable for two of the three, and the ratio of 9:1 for one of the three. (Corrosion rates were above the target 0.015 $lb/ft^2/day$.)

Conventional waste treatment methods (lime, NaOH and air) reduced concentrations of Fe, Cr and Ni in the spent cleaning solution to below 1 ppm.

The test results suggest that at least when Inh "B" is used as the corrosion inhibitor, the citric acid in the cleaning solution functions, in part, as an inhibitor aid.

The test results have demonstrated that 2.0 percent aqueous solutions of 4:1 formic acid to citric acid will hold more than 0.7 percent Fe(II); proportionately higher concentrations of the acid mixture will hold at least 1.5 percent Fe(II).

Contrary to the teachings of Reich, formic acid-citric acid ratios in the range of 4:1 to 9:1 were found, under the test conditions, to hold a stoichiometric concentration of iron (in the ferrous state), with insignificant loss of iron from solution over at least 24 hours.

It should now be apparent that the formic-citric acid mixtures for removing iron oxide scale from steel surfaces within drumless utility boilers as described herein above, possesses each of the attributes set forth in the specification under the heading "Summary of the Invention" herein before. Because it can be modified to some extent without departing from the principles thereof as they have been outlined and explained in this specification, the present invention should be understood as encompassing all such modifications as are within the spirit and scope of the following claims.

What is claimed is:

1. A method for removing iron oxide scale from interior steel surfaces of a drumless boiler, comprising:

contacting said scale with an aqueous cleaning solution containing about 0.5 to about 10 weight percent formic acid and citric acid wherein the formic acid to citric acid weight ratio is from 4:1 to 9: 1, said solution further containing about 0.1 to about 1.0 weight percent corrosion inhibitor effective to inhibit corrosion by organic acids of bared steel of said surfaces to no greater than 0.015 lb/ft/day;

said contacting occurring at a temperature in a range of about 150° F. to about 200° F., at a pH below 7.0, for a contact time of less than 30 hours, and under a reducing atmosphere produced by exclusion of air from said interior surfaces of said drumless boiler and by generation of hydrogen from said contacting of said scale with said aqueous cleaning solution so that removed iron remains in solution; and, thereafter, draining said cleaning solution from the boiler interior.

2. The method of claim 1, wherein:

said cleaning solution further includes 0.25 percent by weight ammonium bifluoride as a scale dissolution accelerating agent.

3. The method of claim 1, wherein:

said cleaning solution further includes up to 1.00 percent by weight hydrofluoric acid as a scale dissolution accelerating agent.

4. The method of claim 1, wherein:

said corrosion inhibiter is an inhibitor of organic acid corrosion which gives a corrosion rate of <0.015 $lb/ft^2/day$ in a test in which four steel corrosion test coupons including at least one of boiler plate, at least one of mild steel, and at least one of low alloy steel are placed in a polytetrafluoroethylene holder which is then placed in a 1000 ml Parr bomb, enough of said corrosion inhibiter is added to said bomb to give a surface/volume ratio of a t least 0.6 $cm^{-1}$, and said bomb is stirred for six hours at a test temperature in a range of 150° F. to 2000° F.

5. The method of claim 1, further including:

treating said cleaning solution drained from said boiler with 1.0 percent lime and sufficient caustic to raise its pH to 12.8; and thereafter, blowing air through said drained cleaning solution to produce a slurry which is red-brown in color, from which an iron-containing slurry settles.

6. The method of claim 1, further including; treating said cleaning solution drained from said boiler with 1.0 percent lime and sufficient caustic to raise its pH to 12.8; and, thereafter, adding peroxide to said drained cleaning solution and agitating, thereby producing a red-brown slurry, from which an iron-containing precipitate settles.

7. A method for removing iron oxide containing scale from the interior surfaces of a steel vessel, comprising:

contacting said scale with an aqueous cleaning solution containing both formic acid and citric acid wherein the weight ratio of formic acid to citric acid is from 4:1 to 9: 1; and maintaining a reducing atmosphere in said vessel during said contacting so that removed iron remains in solution, said reducing atmosphere produced by exclusion of air from the interior of said steel vessel and by generation of hydrogen from said contacting of said scale with said aqueous cleaning solution.

8. The method of claim 7 wherein said formic and citric acids are present in a total amount from about 0.5 to about 10.0 percent-by-weight of said cleaning solution.

9. The method of claim 7 wherein said cleaning solution further comprises a corrosion inhibitor effective to inhibit corrosive attack of organic acids on steel.

10. The method of claim 9 wherein said cleaning solution comprises from about 0.1 to about 1.0 percent-by-weight of said corrosion inhibitor.

11. The method of claim 9 wherein said corrosion inhibitor is present in an amount effective to limit corrosion of bared steel in said vessel to no more than about 0.015 $lb/ft^2/day$.

12. The method of claim 7 wherein said cleaning solution further comprises up to about 1.0 percent-by-weight of a scale dissolution accelerating agent selected from a group consisting of hydrofluoric acid and ammonium bifluoride.

13. The method of claim 7 wherein said contacting is performed at a temperature from about 150° F. to about 200° F.

14. The method of claim 7 wherein said cleaning solution has a pH less than about 7.0.

15. The method of claim 7 wherein said contacting continuous for a duration less than about 30 hours.

16. The method of claim 7 wherein said cleaning solution is circulated through said vessel.

17. The method of claim 7 further comprising:

draining from said vessel a spent cleaning solution containing dissolved scale remove from said vessel; and raising a pH of said spent cleaning solution to at least about 12.8 to precipitate metals dissolved in said solution.

18. The method of claim 17 further comprising:

contacting said spent cleaning solution at a pH of at least about 12.8 with a sufficient amount of an oxidizing agent to decompose said citric acid and precipitate additional metals dissolved in said solution.

19. The method of claim 18 wherein the pH of said spent cleaning solution is raised by adding lime and caustic.

20. The method of claim 19 wherein said oxidizing agent comprises hydrogen peroxide.

21. The method of claim 19 wherein said oxidizing agent comprises air blown through said spent cleaning solution.

* * * * *

UNITED STATES PATENT AND TRADEMARK OFFICE

CERTIFICATE OF CORRECTION

PATENT NO. : 5,679,170
DATED : October 21,1997
INVENTOR(S) : Wayne W. Frenier

It is certified that error appears in the above-indentified patent and that said Letters Patent is hereby corrected as shown below:

In column 8, line 38, insert between "interior" and "surfaces" the word --steel--.
In column 8, line 63, delete "2000°" and replace therefor --200°--.

In column 10, line 17 delete "remove" and replace therefor --removed--.

Signed and Sealed this

Tenth Day of March, 1998

*Attest:*

*Attesting Officer*

BRUCE LEHMAN

*Commissioner of Patents and Trademarks*